US006574345B1

(12) United States Patent
Huang

(10) Patent No.: US 6,574,345 B1
(45) Date of Patent: Jun. 3, 2003

(54) STRUCTURE OF A WEARABLE AND HANDS FREE EARPHONE

(76) Inventor: Kuan-Di Huang, 8F, No. 10-1, Chungshan Rd., Luchu Hsiang, Taoyuan Hsien (TW)

( * ) Notice: Subject to any disclaimer, the term of this patent is extended or adjusted under 35 U.S.C. 154(b) by 0 days.

(21) Appl. No.: 10/103,290

(22) Filed: Mar. 22, 2002

(51) Int. Cl.[7] ..... H04R 25/00

(52) U.S. Cl. ..... 381/380; 381/370; 381/151; 379/430

(58) Field of Search ..... 381/326, 328, 381/151, 380, 370, FOR 130, FOR 133; 379/430

(56) References Cited

U.S. PATENT DOCUMENTS 5,164,984 A * 11/1992 Suhami et al. ..... 381/151
5,295,193 A * 3/1994 Ono ..... 381/151
5,757,934 A * 5/1998 Yokoi ..... 381/151

* cited by examiner

*Primary Examiner*—Huyen Le
(74) *Attorney, Agent, or Firm*—Bacon & Thomas, PLLC

(57) ABSTRACT

A wearable and hands free earphone includes a hollow sleeve of the size able to be fitted into an ear of a user and having a driver element and a microphone element inside. When the user makes a telephone call, voice vibrations are conveyed through the ear of the caller and transmitted to the receiving parry via the microphone element, while the voice of the receiving party is transmitted to the ear of the caller via the driver element. Besides, an isolator component is disposed inside the hollow sleeve between the driver element and the microphone element such that the separation effectively reduces acoustic cross talk interference between the driver element and microphone element.

5 Claims, 3 Drawing Sheets

STRUCTURE OF A WEARABLE AND HANDS FREE EARPHONE

BACKGROUND OF THE INVENTION

1) Field of the Invention

The invention herein relates to cellular telephone accessories, specifically to an improved structure of a wearable and hands free earphone.

2) Description of the Prior Art

Conventional cellular telephones are carried according to the actual needs of the user. For example, they may be hung from the waist or kept in a pocket. When the user is driving and the said cellular telephone rings, one hand must be used to grasp the said cellular telephone while the other hand tends to drive. As such, safe driving is seriously compromised. Some units are equipped with a small microphone that is suitably clipped onto the body of the user to facilitate telephone usage, but that results in the following difficulties.

Since the said small microphone is clipped onto the body of the user, the voice of the user is accompanied by external noise (such as vehicle sounds and music, etc.) in the immediate environment and speaking volume is increased. As such, this results in poor sound quality to the party to which the call is directed in that the voice of the caller is received along with a high level of background noise.

Some cellular telephone units utilize a throat-type microphone that is worn around the neck of the user such that sound vibrations from the throat are conveyed to the microphone to enable conversation with the said party. However, since the said throat-type microphone is worn against the throat, this results in user discomfort.

Based on the said description, utilizing the small microphone clipped onto the body of the user enables speaking to the said party with adequate volume but also entails the transmission of background noise and other shortcomings. As such, if a hands free earphone structure that is an improvement upon the said conventional small microphone and the said throat-type microphone could be designed, the design of the said hands free earphone would be welcomed by consumers because of increased independence as well as the enhanced sound heard by the receiving party.

SUMMARY OF THE INVENTION

The objective of the invention herein is to provide an improved structure of a wearable and hands free earphone in which the hollow sleeve of the said earphone structure is fitted into the ear of the user and, through a driver element and a microphone element contained inside the said sleeve, when the user makes a telephone call, voice vibrations are conveyed through the ear of the caller and transmitted to the receiving party via the microphone, while the voice of the said party is transmitted to the ear of the caller via the said driver element. At the same time, an isolator component is disposed between the said driver element and the said microphone element such that the separation appropriately provided effectively reduces acoustic cross talk interference between the said driver element and microphone element. As such, the microphone element in the ear of the user is effectively shielded from external noise and enables the user to converse clearly with the said party, thereby improving upon the conventional hands free earphone which receives the sound of the voice along with high levels of external noise.

The above and other objects, features and advantages of the present invention will become apparent from the following detailed description taken with the accompanying drawings.

DETAILED DESCRIPTION OF THE INVENTION

Figure 1:
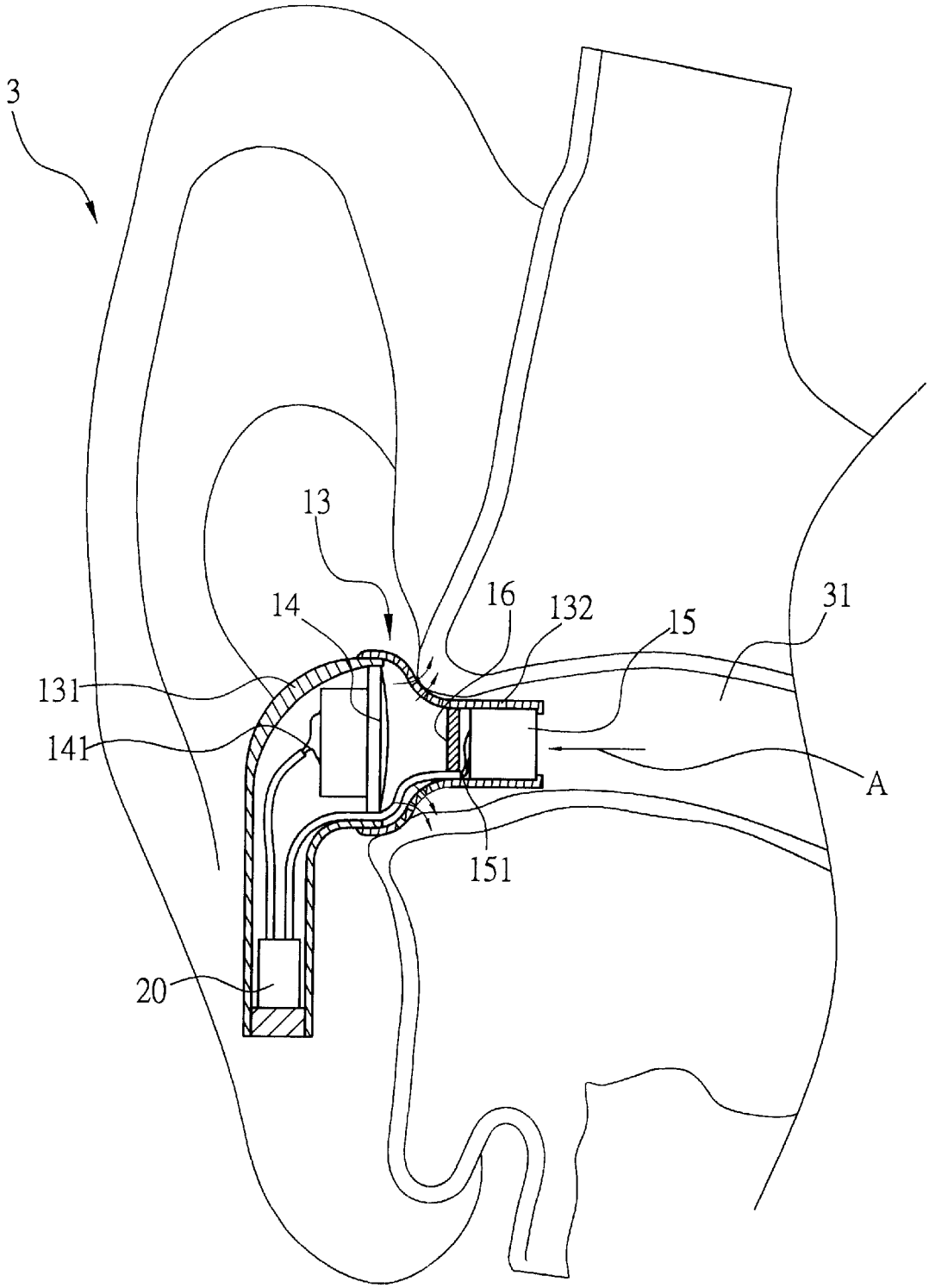
FIG. 1 is a cross-sectional drawing of the invention herein.

Referring to FIG. 1, the improved structure of a wearable and hands free earphone of the invention herein is comprised of a driver element 14 and a microphone element 15 disposed in an earphone structure I that fits into the ear 3 of the user to effectively screen out external noise, enabling the user to converse clearly with parties during cellular telephone calls.

Of the five sense organs, since the three organs of the ear 3, the nose, and the throat are closely interrelated and interconnected, when sound is produced by the throat, reverberations from vocal cord friction are conveyed via the auditory tube to the tympanic membrane of the ear 3 and the vibration of the tympanic membrane enables the hearing of ones own voice, and the invention herein utilizes and expands upon this aspect of human physiological principles.

Figure 2:
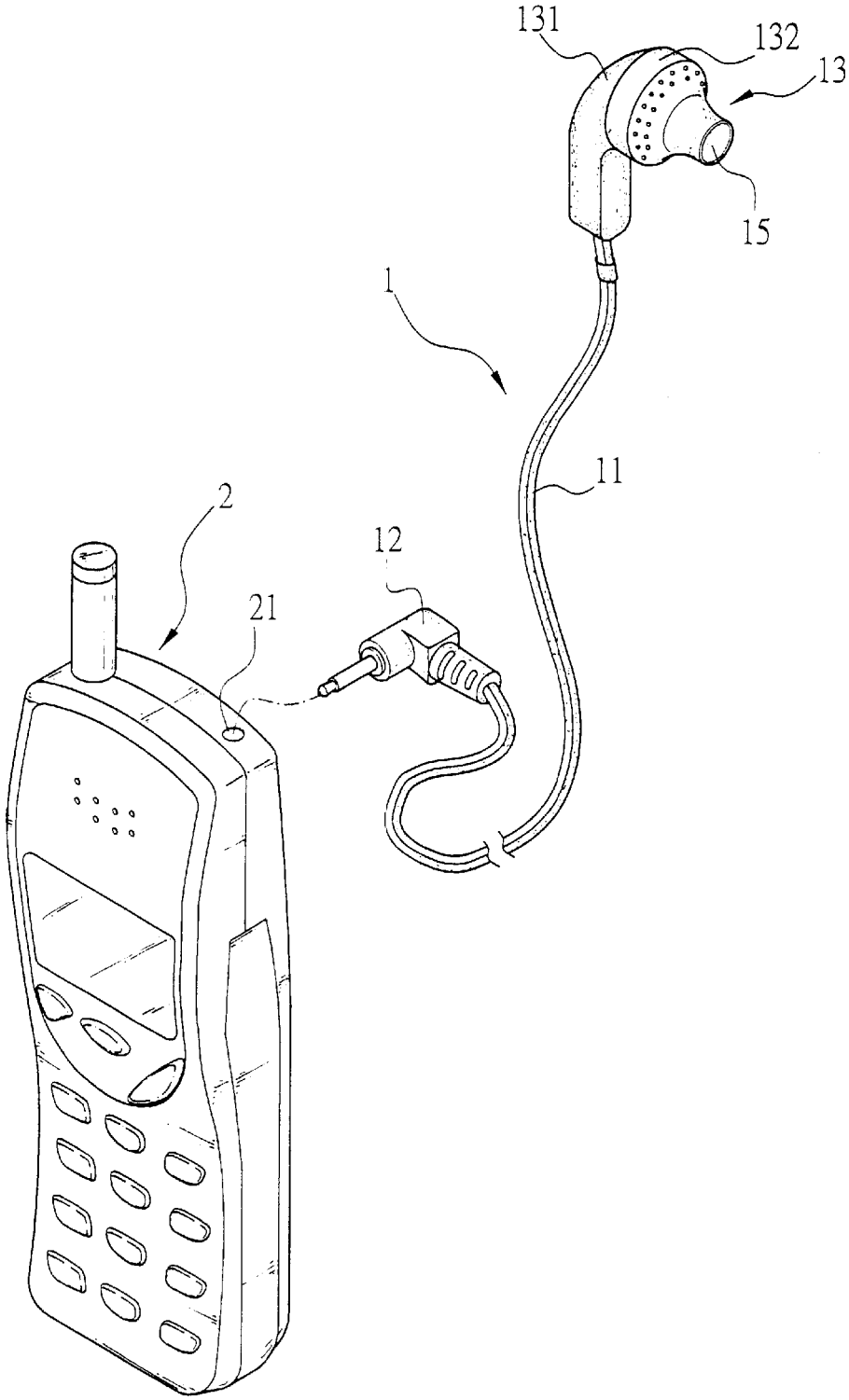
FIG. 2 is an isometric drawing of another embodiment of the invention herein.
Figure 3:
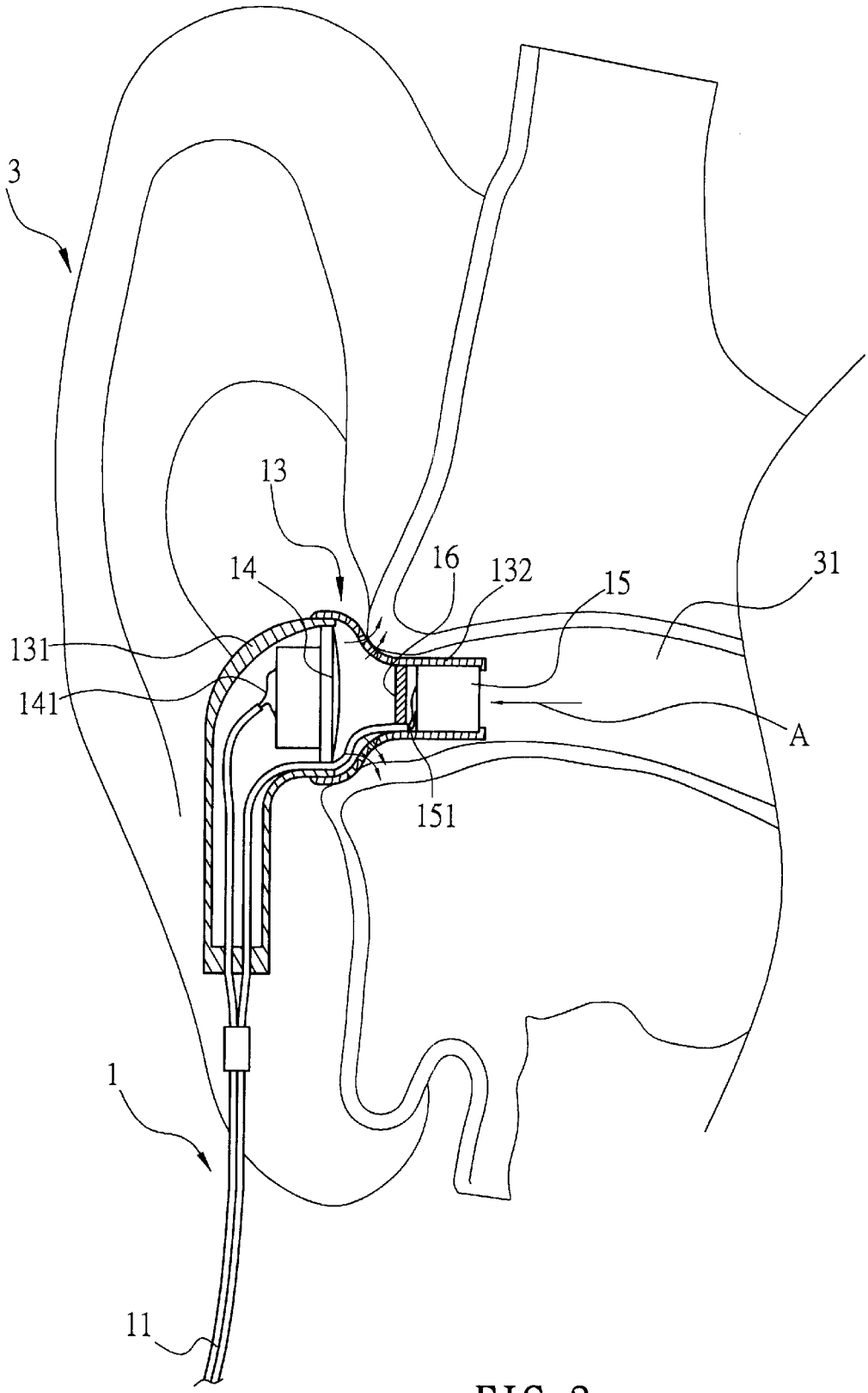
FIG. 3 is a cross-sectional drawing of another embodiment of the invention herein.

In the invention herein, referring to FIG. 1, FIG. 2, and FIG. 3, the said earphone structure 1 has a hollow sleeve 13 that is ergonomically compliant; the said hollow sleeve 13 consists of a first sleeve section 131 conjoined to a second sleeve section 132 and an opening respectively formed in each of its opposite extremities such that the said hollow sleeve 13 fits into the external acoustic meatus 31 of the ear 3; a crystal 20 capable of receiving and transmitting signals is situated in the opening in one end of the said first sleeve section 131, a driver element 14 is contained in the primary chamber of the said first sleeve section 131, and a microphone element 15 is contained in the secondary chamber of the said second sleeve section 132, wherein the said driver element 14 and microphone element 15 are respectively connected to audio frequency signal transmission lines 141 and 151, with the opposite ends of the said lines 141 and 151 respectively connected to the said signal reception and transmission crystal 20 such that the said crystal 20 is capable of conveying audio wirelessly to and from a cellular telephone 2.

In the invention herein, the said driver element 14 is contained in the primary chamber of the said first sleeve section 131 and the said microphone element 15 is contained in the secondary chamber of the said second sleeve section 132 and, furthermore, an isolator component 16 is disposed a certain distance away from the said driver element 14 as a medium in between the said driver element 14 and microphone element 15 such that the separation appropriately provided by the said isolator component 16 effectively reduces acoustic cross talk interference between the said driver element 14 and microphone element 15.

Referring to FIG. 2 and FIG. 3, the drawings of another embodiment of the invention herein, the said earphone structure 1 is equipped with a signal cord 11 (however, another type of material can be substituted by those familiar with the relevant technology); one end of the said signal cord 11 is coupled into the opposite extremity of the first sleeve section 131 and the other end of the said signal cord 11 is connected to a plug 12 such that the said plug 12 can be inserted into the socket 21 of the said cellular telephone 2 to enable the hard wire to transmit and receive audio frequency signals.

In the invention herein, the said second sleeve section 132 is constructed of a pliant material. When the said structure of the invention herein is utilized, the said hollow sleeve 13 is placed into the ear 3 in either the wireless reception mode or by inserting the said plug 12 into the cellular telephone 2 socket 21 such that as the user speaks, sound is transferred through the said ear 3 and conveyed to the said microphone element 15 and the voice of the conversing party is reproduced by the driver element 14 in the ear 3 of the user, while interference between the output of the said drive element 14 and the input of the said microphone element 15 is effectively minimized by the appropriate separation of isolator component 16 and, as such, the microphone element 15 in the ear 3 of the user is effectively shielded from external noise and enables the user to converse clearly with the said party, thereby improving upon the conventional hands free earphone which receives the sound of the voice along with high levels of external noise.

While the invention has been described by means of specific embodiments, numerous modifications and variations could be made thereto by those skilled in the art without departing from the scope and spirit of the invention set forth in the claims.

What is claimed is:

1. An improved structure of a wearable and hands free earphone comprised of:

a hollow sleeve, the said hollow sleeve having an opening formed at one end and a chamber within its interior;

a driver element contained inside the said chamber, the dimensions of which permit insertion into an ear of a user, and connected to an audio frequency signal transmission line;

a microphone element contained in the said chamber at its outer side near the said opening and situated a certain distance away from the said driver element, the dimensions of which are smaller than that of the said driver element such that the said microphone element fits into the ear, and said microphone being connected to another audio frequency signal transmission line;

wherein the said microphone element receives sound vibrations through the ear and the said sound is transferred via its said transmission line, while the said driver element conveys audio into the ear from its said transmission line, and wherein the hollow sleeve is comprised of:

a first sleeve section conjoined to a second sleeve section;

an opening formed in one extremity of the said first sleeve section and a primary chamber disposed within it, wherein the said driver element is situated inside the said primary chamber and its dimensions permit insertion into the ear;

an opening formed in one extremity of the said second sleeve section, said one extremity being insertable into the said first sleeve section opening, and another opening formed in the opposite extremity of the said second sleeve section that provides for the installation of the said microphone element such that a certain distance is maintained between it and the said driver element, and wherein the dimensions of the said microphone element are smaller than the dimensions of the said drivel element, enabling placement of the said microphone element into the ear.

2. As mentioned in claim 1 of the said improved structure of a wearable and hands free earphone of the invention herein, the said driver element and the said microphone element have an isolator component disposed between them such that the separation appropriately provided by the said isolator component effectively reduces acoustic cross talk interference between the said driver element and the said microphone element.

3. As mentioned in claim 1 of the said improved structure of a wearable and hands free earphone of the invention herein the said improved structure is further comprised of a crystal capable of receiving and transmitting signals; the said crystal is situated inside the other end of the said sleeve chamber and respectively connected to the said transmission lines of the said driver element and the said microphone element, and thereby utilized in a wireless mode for audio frequency signal transmission and reception.

4. As mentioned in claim 1 of the said improved structure of a wearable and hands free earphone of the invention herein, the said improved structure is further comprised of a signal cord, one end of the said signal cord is coupled into the opposite extremity of the said sleeve chamber and respectively connected to the said driver element and the said microphone element transmission lines, while its other end is inserted into a socket to enable the hard wire to transmit and receive of audio frequency signals.

5. As mentioned in claim 1 of the said improved structure of a wearable and hands free earphone of the invention herein, the said second sleeve section is constructed of a pliant material.

* * * * *